US010955786B2

(12) United States Patent
Murata

(10) Patent No.: US 10,955,786 B2
(45) Date of Patent: Mar. 23, 2021

(54) SHEET FEEDING APPARATUS AND IMAGE FORMING APPARATUS

(71) Applicant: CANON KABUSHIKI KAISHA, Tokyo (JP)

(72) Inventor: Wataru Murata, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 130 days.

(21) Appl. No.: 16/050,330

(22) Filed: Jul. 31, 2018

(65) Prior Publication Data

US 2019/0041787 A1 Feb. 7, 2019

(30) Foreign Application Priority Data

Aug. 7, 2017 (JP) ..... JP2017-152483

(51) Int. Cl.
*G03G 15/00* (2006.01)
*G03G 15/16* (2006.01)

(52) U.S. Cl.
CPC ..... *G03G 15/6511* (2013.01); *G03G 15/1615* (2013.01); *G03G 15/5029* (2013.01); *B65H 2405/11* (2013.01)

(58) Field of Classification Search
CPC ..... G03G 15/6511
USPC ..... 399/388
See application file for complete search history.

(56) References Cited

U.S. PATENT DOCUMENTS 7,523,930 B2 * 4/2009 Kang ..... B65H 1/20 271/126
7,643,762 B2 * 1/2010 Eto ..... G03G 15/553 399/23
8,010,035 B2 * 8/2011 Furushige ..... G03G 15/50 399/393
9,162,837 B2 * 10/2015 Sugiyama ..... G03G 15/553
9,944,479 B2 4/2018 Nakagawa
10,053,312 B2 8/2018 Nakagawa
10,386,771 B2 * 8/2019 Minamino ..... B65H 7/06
2005/0286947 A1 * 12/2005 Kitamura ..... B65H 1/12 399/393
2010/0117294 A1 * 5/2010 Maekawa ..... B65H 3/063 271/265.01

(Continued)

FOREIGN PATENT DOCUMENTS

JP 2003-246468 A 9/2003

OTHER PUBLICATIONS

U.S. Appl. No. 16/108,112, filed Aug. 22, 2018, to Hiroyuki Nakagawa (now U.S. Pat. No. 10,775,730).

*Primary Examiner* — Anthony H Nguyen
(74) *Attorney, Agent, or Firm* — Venable LLP

(57) ABSTRACT

A sheet feeding apparatus includes a sheet stacking portion on which sheets are stacked in a storage unit; a lifting and lowering unit configured to move the sheet stacking portion between a first position and a second position above the first position; and a control unit configured to execute a first mode of waiting for start of feeding processing in a state in which the sheet stacking portion is at the first position and a second mode of waiting for start of the feeding processing in a state in which the sheet stacking portion is held at the second position by the lifting and lowering unit. The control unit executes the first mode when sheets of a first amount are stacked and execute the second mode when sheets of a second amount less than the first amount are stacked.

9 Claims, 14 Drawing Sheets

(56) References Cited

U.S. PATENT DOCUMENTS

| | | | | |
|---|---|---|---|---|
| 2012/0187620 | A1* | 7/2012 | Kitamura | B65H 1/14<br>271/10.01 |
| 2013/0221607 | A1* | 8/2013 | Chiba | B65H 7/02<br>271/117 |

* cited by examiner

SHEET FEEDING APPARATUS AND IMAGE FORMING APPARATUS

BACKGROUND OF THE INVENTION

Field of the Invention

The present invention relates to a sheet feeding apparatus configured to feed sheets and an image forming apparatus.

DESCRIPTION OF THE RELATED ART

For a sheet feeding apparatus to be used for image forming apparatus such as a printer, a facsimile machine, or a copying machine, there has been employed a configuration in which a sheet stacking portion capable of being lifted and lowered in a state in which sheets are stacked thereon is provided, and the sheets stacked on the sheet stacking portion are fed by a feeding unit. A sheet feeding apparatus described in Japanese Patent Application Laid-Open No. 2003-246468 includes a bottom plate, a push-up arm, and a motor. The bottom plate is arranged on a feeding cassette removably mounted to an apparatus main body. The push-up arm is configured to push up the bottom plate. The motor is arranged in the apparatus main body, and is configured to drive the push-up arm. When the feeding cassette is mounted to the apparatus main body, drive of the motor is started to push up the bottom plate. The drive of the motor is stopped in a state in which an upper surface of the sheets is held in abutment against a pick roller.

Incidentally, as a larger number of sheets can be stacked on the sheet stacking portion, a load for lifting and lowering the sheet stacking portion becomes larger. Therefore, durability against the mechanical load is required for members such as the push-up arm. However, with the configuration described in Japanese Patent Application Laid-Open No. 2003-246468, after the feeding cassette is mounted to the apparatus main body, the state in which the bottom plate is pushed up by the push-up arm is maintained, with the result that a load continuously acts on the push-up arm or on a gear train interposed between the motor and the push-up arm. When deformation of the member is caused by such load, for example, a change in inter-axial distance between gears forming the gear train occurs, with the result that there is a risk of causing degradation in stability of the operation of lifting and lowering the bottom plate.

SUMMARY OF THE INVENTION

Therefore, the present invention provides a sheet feeding apparatus configured to stably perform an operation of lifting and lowering sheets for a long period of time.

According to one embodiment of the present invention, a sheet feeding apparatus comprises:

a storage unit configured to store sheets;

a sheet stacking portion provided in the storage unit so that the sheets are stacked on the sheet stacking portion, the sheet stacking portion being configured to be lifted and lowered relative to the storage unit;

a feeding unit configured to feed the sheets stacked on the sheet stacking portion;

a lifting and lowering unit configured to move the sheet stacking portion between a first position at which the sheet stacking portion abuts against a bottom portion of the storage unit and a second position above the first position;

a detection unit configured to detect an amount of the sheets stacked on the sheet stacking portion; and a control unit configured to perform feeding processing of causing the feeding unit to feed the sheets stacked on the sheet stacking portion in a state in which the sheet stacking portion is at the second position, wherein the control unit executes a first mode of waiting for start of the feeding processing in a state in which the sheet stacking portion is at the first position and a second mode of waiting for start of the feeding processing in a state in which the sheet stacking portion is held at the second position by the lifting and lowering unit, and wherein the control unit is configured to execute the first mode when sheets of a first amount are stacked on the sheet stacking portion based on a detection result of the detection unit and execute the second mode when sheets of a second amount smaller than the first amount are stacked on the sheet stacking portion.

Further features of the present invention will become apparent from the following description of exemplary embodiments with reference to the attached drawings.

DESCRIPTION OF THE EMBODIMENTS

Now, with reference to the drawings, a description will be provided of an image forming apparatus according to the present disclosure. The image forming apparatus includes a printer, a copying machine, a facsimile machine, or a multifunction peripheral, and is configured to form an image on a sheet, which is to be used as a recording medium, based on image information input from an external PC or image information read from an original. The sheet to be used as a recording medium includes paper such as a sheet or an envelope, a plastic film for an overhead projector, or a cloth.

Figure 1:
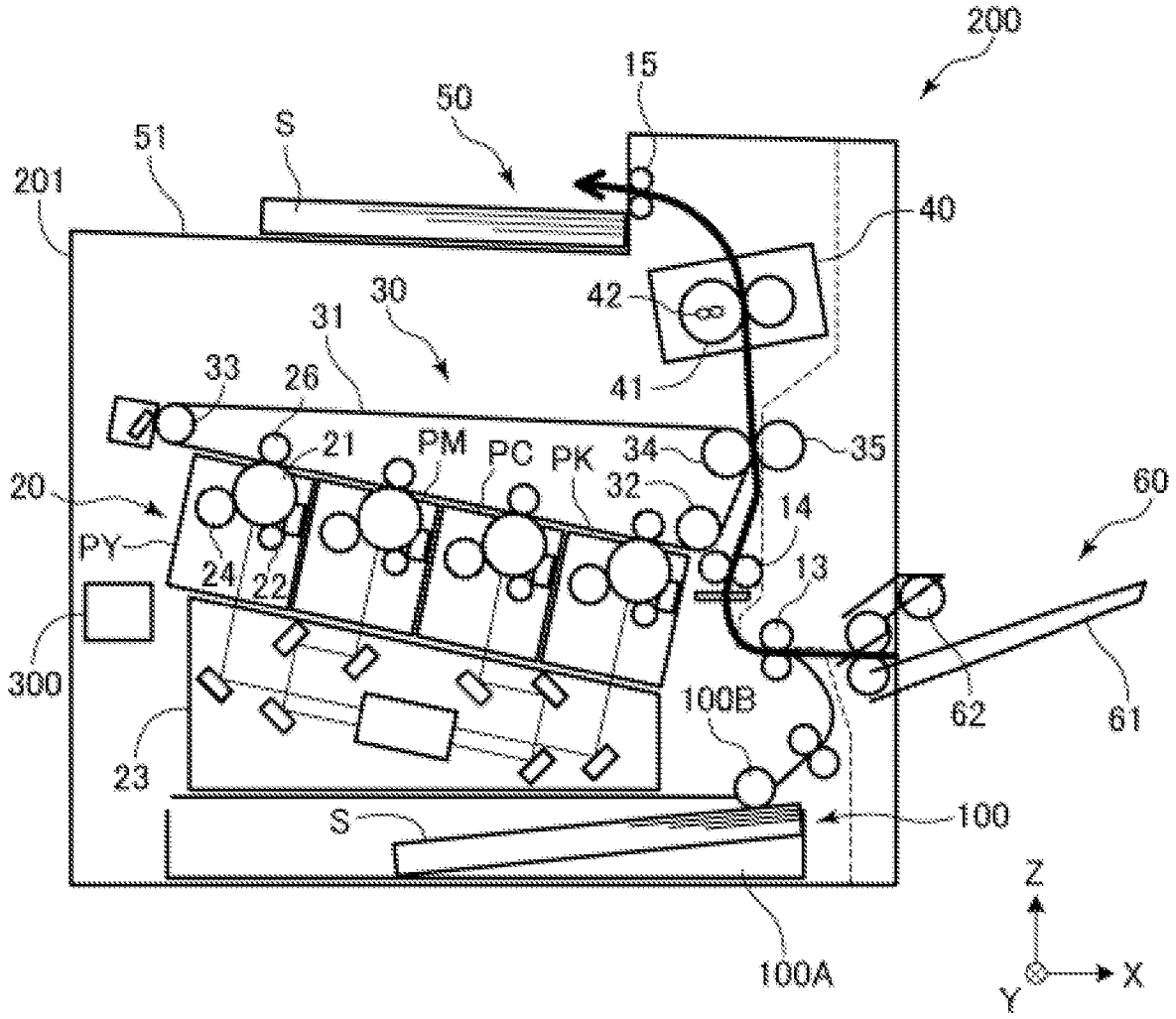
FIG. 1 is a schematic view for illustrating an image forming apparatus according to the present disclosure.

As illustrated in FIG. 1, an apparatus main body 201 of an image forming apparatus 200 accommodates an image forming portion 20. The image forming portion 20 has a configuration of an intermediate transfer tandem type including four image forming units PY, PM, PC, and PK and an intermediate transfer belt 31. That is, the image forming portion 20 is configured to form toner images by the image forming units PY to PK and transfer the toner images to a sheet S through the intermediate transfer belt 31. The image forming units PY to PK have basically the same configuration except that colors of toner to be used for development are different. Therefore, description is made of the configuration of the image forming unit and an operation of forming a toner image through description of the image forming unit PY for yellow as an example.

When a request for forming a toner image is given to the image forming unit PY, a photosensitive drum 21 being a photosensitive member is driven to rotate, and a charging device 22 uniformly charges a surface of the photosensitive drum 21. An exposure device 23 provided in a lower part of the apparatus main body 201 irradiates the photosensitive drum 21 with laser light based on image information to expose a drum surface to light, to thereby form an electrostatic latent image on the photosensitive drum 21. Then, the electrostatic latent image is formed into a visible image (developed) with toner supplied from a developing device 24, thereby forming a toner image on the surface of the photosensitive drum 21.

In a similar manner, toner images of corresponding colors are formed also on surfaces of photosensitive drums 21 in the image forming units PM, PC, and PK. The toner images formed by the image forming units PY to PK are primarily transferred by primary transfer rollers 26 from the photosensitive drums 21 to the intermediate transfer belt 31 being an intermediate transfer member. Adhering substances such as toner which remain on the photosensitive drums 21 are removed by cleaning devices provided to the image forming units PY to PK.

The intermediate transfer belt 31 is stretched around a secondary transfer inner roller 34, a tension roller 32, and a tensioning roller 33, and is driven to rotate in a counterclockwise direction in FIG. 1. The toner images borne on the intermediate transfer belt 31 are secondarily transferred to the sheet S at a secondary transfer portion formed between a secondary transfer roller 35, which is opposed to the secondary transfer inner roller 34, and the intermediate transfer belt 31. Adhering substances such as toner which remain on the intermediate transfer belt 31 are removed by a belt cleaning device. The sheet S having the toner images transferred thereto is conveyed to a fixing device 40. The fixing device 40 includes a fixing roller pair 41 and a heat source 42. The fixing roller pair 41 is configured to nip and convey the sheet S. The heat source 42 is configured to heat the sheet S. The fixing device 40 applies heat and pressure to the toner images while conveying the sheet S. With this, the toner is melted and sticks to the sheet S to be fixed thereon.

In parallel with such image forming process, a feeding operation of feeding the sheet S from the sheet feeding apparatus 100 or a manual-feed feeding apparatus 60 to the image forming portion 20 is performed. The sheet feeding apparatus 100 includes a sheet storing portion 100A configured to store the sheet S and a feeding unit 100B configured to feed the sheet S from the sheet storing portion 100A. Moreover, the manual-feed feeding apparatus 60 includes a manual-feed tray 61 and a feeding unit 62 configured to feed the sheet S set on the manual-feed tray 61. The feeding units 100B and 62 each include a pickup roller, a feed roller, and a separation roller. The pickup roller is configured to send out the sheet S. The feed roller is configured to receive the sheet S from the pickup roller and convey the sheet S. The separation roller is brought into abutment against the feed roller, and is driven to rotate in a direction opposite to a sheet feeding direction. The feeding units 100B and 62 are each an example of a feeding unit configured to feed the sheet S, and may be replaced with feeding units of another type such as a separation pad type or an air-feeding type.

The sheet S having been sent out from the feeding unit 100B is conveyed to a registration roller pair 14 through a pre-registration roller pair 13. The registration roller pair 14 is configured to correct skew feed of the sheet S by being brought into abutment against a leading edge of the sheet S, that is, a downstream edge of the sheet S in a sheet conveying direction, and send the sheet S to the secondary transfer portion at a timing in accordance with progress of the image forming process performed by the image forming portion 20. The sheet S having an image formed thereon by passing through the secondary transfer portion and the fixing device 40 is conveyed to a sheet delivery portion 50 and is delivered by a delivery roller pair 15 to a delivery tray 51 provided on an upper part of the apparatus main body 201.

First Embodiment

Now, with reference to FIG. 2A to FIG. 11, description is made of a configuration and an operation of the sheet feeding apparatus 100 according to a first embodiment of the present invention. Directions of coordinate axes are illustrated as needed. The right-and-left direction in FIG. 1 is referred to as "X-axis direction". The depth direction of the image forming apparatus 200 is referred to as "Y-axis direction". The up-and-down direction is referred to as "Z-axis direction".

Figure 2A:
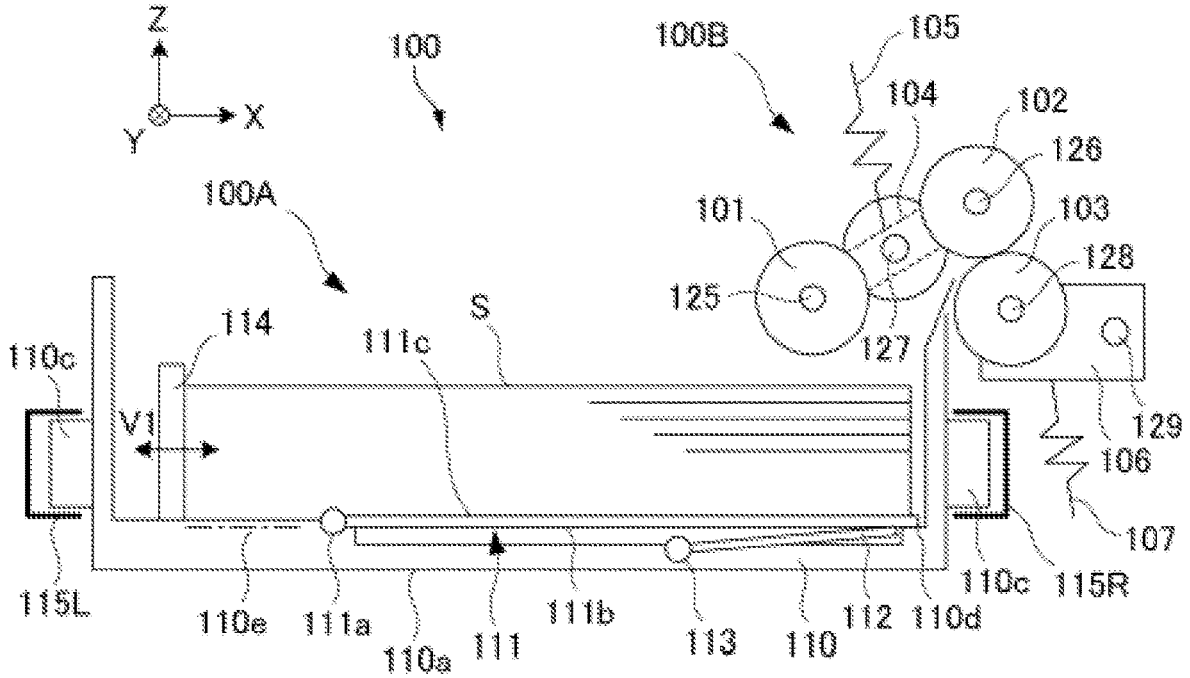
FIG. 2A is a schematic view for illustrating a sheet feeding apparatus according to a first embodiment of the present invention in a state in which a placement plate is at a lower limit position.
Figure 2B:
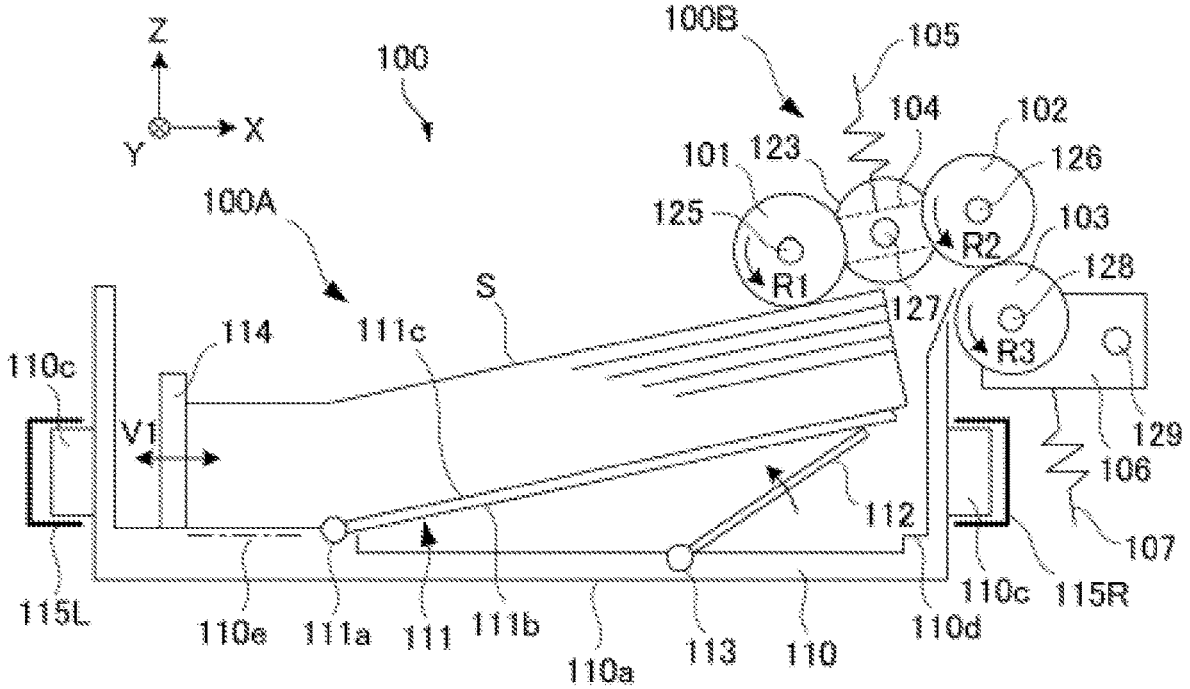
FIG. 2B is a schematic view for illustrating the sheet feeding apparatus according to the first embodiment in a state in which the placement plate is at a feeding position.
Figure 3:
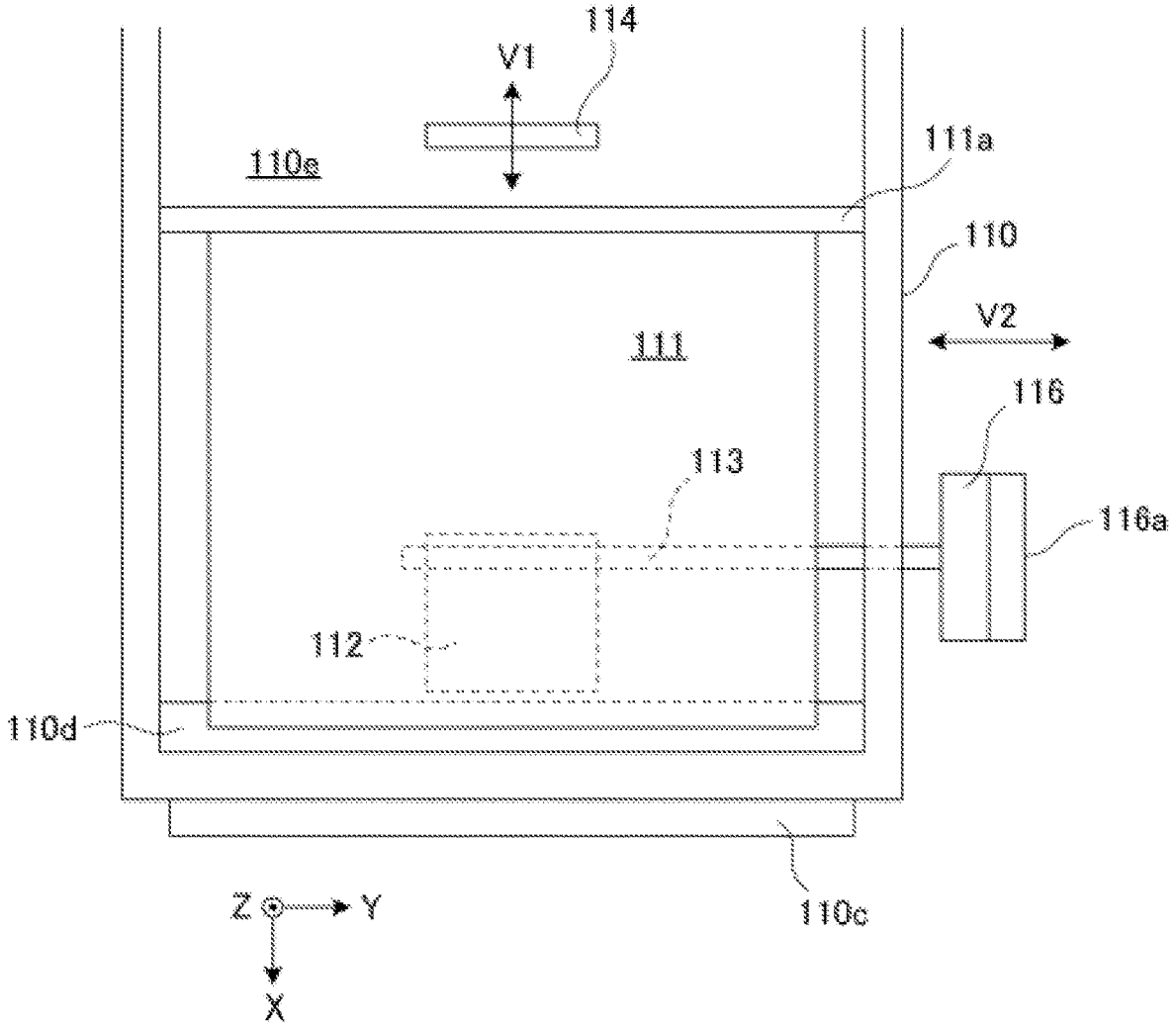
FIG. 3 is a schematic view for illustrating the sheet feeding apparatus according to the first embodiment as seen from above.
Figure 4:
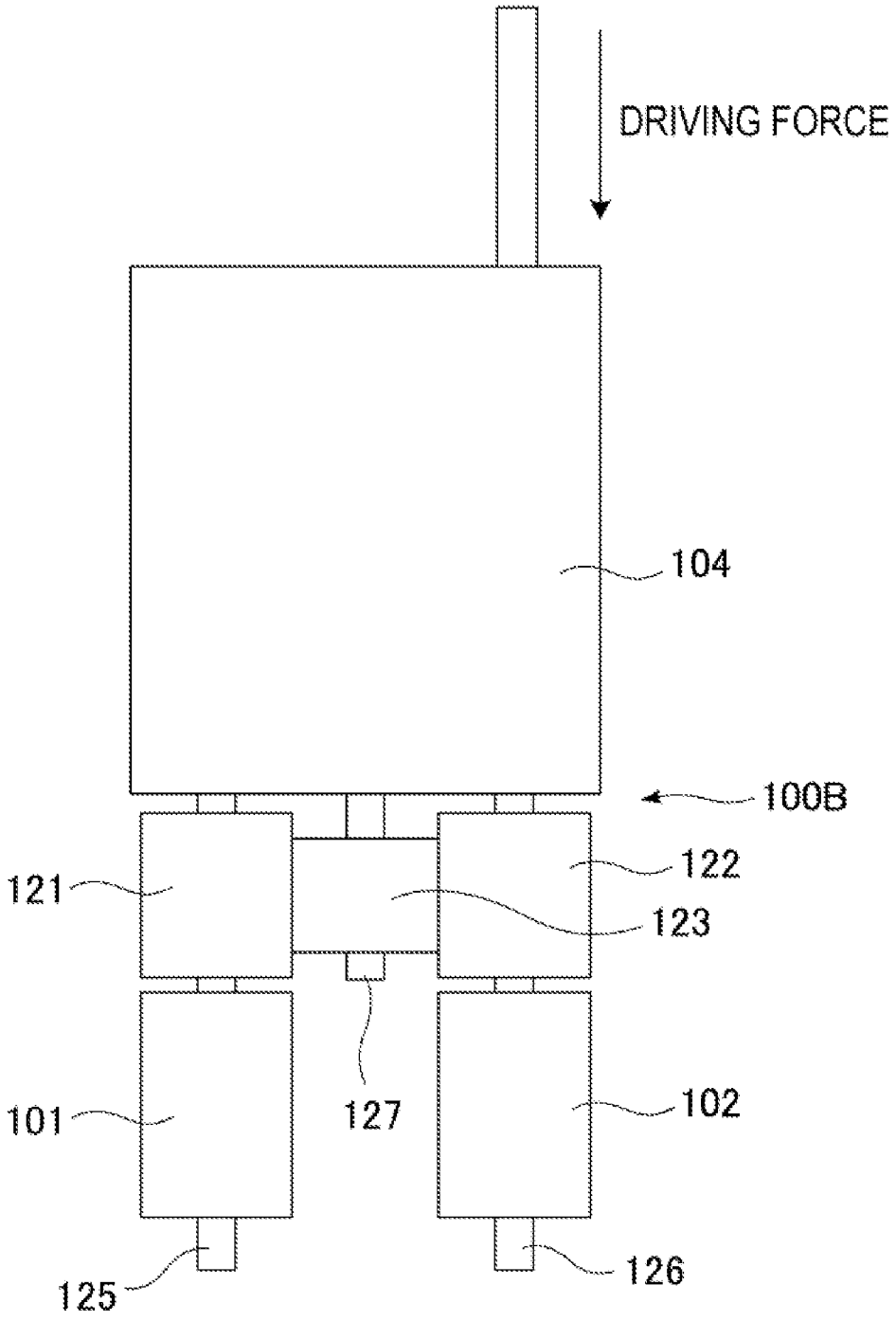
FIG. 4 is a schematic view for illustrating a feeding unit in the first embodiment.

FIG. 2A is a schematic view for illustrating the sheet feeding apparatus 100 in a state in which a placement plate 111 is at a lower limit position. FIG. 2B is a schematic view for illustrating the sheet feeding apparatus 100 in a state in which the placement plate 111 is at a feeding position. FIG. 3 is a schematic view for illustrating the sheet feeding apparatus 100 as seen from above. FIG. 4 is a schematic view for illustrating the feeding unit 100B as seen from an upper side.

As illustrated in FIG. 2A, the sheet feeding apparatus 100 includes the sheet storing portion 100A and the feeding unit 100B. The sheet storing portion 100A is configured to store the sheets S. The feeding unit 100B is configured to separate the sheets S one after another and feed the sheets S. The sheet storing portion 100A includes a storage (cassette) 110, the placement plate 111, and a lifting and lowering plate 112. The placement plate 111 can be lifted and lowered relative to a bottom portion 110*a* of the storage 110. The lifting and lowering plate 112 is configured to lift and lower the placement plate 111. The placement plate 111 is a plate-shaped member which is rotatable in the up-and-down direction about a rotation center portion 111*a* provided at an upstream edge in the sheet feeding direction (rightward direction in FIG. 2A and FIG. 2B). The placement plate 111 is configured to support the sheets S placed on a placement surface 111*c* on an upper side. The placement plate 111 has, as a second surface on a side opposite to the placement surface 111*c* being a first surface, an abutment surface 111*b* which can be brought into abutment against the bottom portion 110*a* of the storage 110. The placement plate 111 is lifted and lowered by being pressed on the abutment surface 111*b* by the lifting and lowering plate 112. The lifting and lowering plate 112 is a rotary member which is mounted to a rotary shaft 113 supported on the storage 110 so as to be rotatable and is rotated integrally with the rotary shaft 113.

The placement plate 111 corresponds to a sheet stacking portion configured to receive sheets stacked thereon. The storage 110 corresponds to a storage unit configured to support the sheet stacking portion so that the sheet stacking portion can be lifted and lowered. Moreover, the lifting and lowering plate 112 and the rotary shaft 113 correspond to a lifting and lowering unit configured to lift and lower the sheet stacking portion.

The sheet storing portion 100A further includes a trailing edge regulating portion 114, a pair of side edge regulating portions, and holding portions 110*c*. The trailing edge regulating portion 114 is movable in a direction V1 along the sheet feeding direction, and is configured to regulate a position of a trailing edge of the sheets S, that is, a position of an upstream edge of the sheets S in the sheet feeding direction. The side edge regulating portions (not shown) are movable in a direction (width direction) orthogonal to the sheet feeding direction as seen from above, and is configured to regulate positions of side edges of the sheets S. The holding portions 110*c* are provided so as to protrude on both outer sides of the storage 110 in the X-axis direction, and are supported so as to be movable in the Y-axis direction by cassette rails 115L and 115R fixed to the apparatus main body 201 of the image forming apparatus 200. With this, the storage 110 has a configuration of a cassette which is drawably mounted to the apparatus main body 201.

As illustrated in FIG. 3, a lifting and lowering gear 116 having a fan shape is fixed to an end portion of the rotary shaft 113 in an axial direction of the rotary shaft 113 to which the lifting and lowering plate 112 is mounted. The lifting and lowering plate 112 is rotated by a driving force transmitted from a drive unit, which is described later, to the lifting and lowering gear 116. Along with the rotation of the lifting and lowering plate 112, the placement plate 111 moves to a lower limit position (first position, FIG. 2A) at which at least a part of the abutment surface 111*b* is brought into abutment against the bottom portion 110*a* of the storage 110, and to a feeding position (second position, FIG. 2B) which is above the lower limit position.

In the first embodiment, a placement plate support portion 110*d* is provided at an end portion of the storage 110 on a downstream side in the sheet feeding direction. The placement plate support portion 110*d* is brought into abutment against the abutment surface 111*b* at a height equal to that of an upstream-side placement surface 110*e* configured to support the sheets S on an upstream side of the rotation center portion 111*a* of the placement plate 111. When the placement plate 111 is at the lower limit position, the weight of the sheets S placed on the placement plate 111 is supported on the storage 110 through the upstream-side placement surface 110*e* and the placement plate support portion 110*d*. Further, the weight of the storage 110 including the sheets S is supported on the apparatus main body 201 through the cassette rails 115L and 115R.

Next, with reference to FIG. 2A, FIG. 2B, and FIG. 4, description is made of the feeding unit 100B. FIG. 4 is a schematic view for illustrating the feeding unit 100B as seen from an upper side.

As illustrated in FIG. 4, the pickup roller 101 is rotatably supported on a drive shaft 125 fixed to a feeding arm 104, and is rotated by transmission of drive from a pickup gear 121 through a coupling (not shown). The feed roller 102 is rotatably supported on a feeding shaft 126 rotatably supported on the feeding arm 104, and is rotated by transmission of drive from a feeding gear 122 through a coupling (not shown). Moreover, the feeding gear 122 and the feeding shaft 126 are fixed so as not to be rotatable relative to each other, and are integrally rotated. The pickup gear 121 is connected to the feeding gear 122 by drive connection through intermediation of an idler gear 123 rotatably supported by an idler shaft 127 fixed to the feeding arm 104.

As illustrated in FIG. 2A, the feeding arm 104 is supported so as to be rotatable in the up-and-down direction about the feeding shaft 126 by a feeding frame (not shown) fixed to a frame of the apparatus main body 201. The feeding arm 104 is caused to wait at the position illustrated in FIG. 2A (waiting position of feeding arm) by being urged downward by a feeding arm pressurizing spring 105 having one end fixed to the feeding frame.

As illustrated in FIG. 2B, when a driving force of a feed motor being a drive source is transmitted to the feeding shaft 126, the feed roller 102 is driven to rotate by the feeding gear 122 in a rotation direction R2 along the sheet feeding direction. Moreover, when the pickup gear 121 is rotated by the feeding gear 122 through the idler gear 123, the pickup roller 101 is driven to rotate in a rotation direction R1 which is the same as the rotation direction of the feed roller 102.

The feeding unit 100B further includes a separation roller 103 rotatably supported on a separation shaft 128 and provided at a position opposed to the feed roller 102. The separation shaft 128 is rotatably supported by a separation frame 106, and the separation frame 106 is supported so as to be rotatable relative to the feeding frame through a separation frame shaft 129. The separation frame 106 is pressurized upward by a separation pressurizing spring 107 having one end fixed to the feeding frame so that the separation roller 103 presses the feed roller 102. Moreover, a torque limiter (not shown) is fixed to the separation shaft 128, and a driving force in a rotation direction R3 against the sheet feeding direction is input from the feed motor. With this, the separation roller 103 is capable of separating an uppermost sheet S, which is fed by the feed roller 102, from other sheets S.

As illustrated in FIG. 2B, when the lifting and lowering plate 112 rotates upward to lift up the placement plate 111 so that a lift-up operation of lifting the sheets S is performed, an upper surface of the uppermost sheet S pushes the pickup roller 101 upward. Along with this operation, the feeding arm 104 rotates upward about the feeding shaft 126 so that the pickup roller 101 is brought into press contact with the sheet S by an elastic force of the feeding arm pressurizing spring 105. When a sheet height detection unit detects that the feeding arm 104 has moved so that the upper surface of the uppermost sheet S reaches a predetermined position, the lift-up operation of the lifting and lowering plate 112 is stopped. The predetermined position is a position which is set so that the pickup roller 101 is held in abutment against the uppermost sheet S with a pressurizing force suitable for feeding the sheet S, and indicates a height of the upper surface of the sheet S in a case in which the placement plate 111 is at the feeding position. The sheet height detection unit continuously detects a sheet height also during the feeding operation. When the feeding arm 104 is lowered by a predetermined amount from the predetermined position due to consumption of the sheets S, the lift-up operation is performed again as a response to a change in detection signal so that the sheet height is controlled so as to be maintained at the predetermined position. As the sheet height detection unit, there may be used, for example, a photoelectric sensor which is capable of detecting a rotation angle of the feeding arm 104 by detecting a light-blocking portion projecting from the feeding arm 104.

Figure 5:
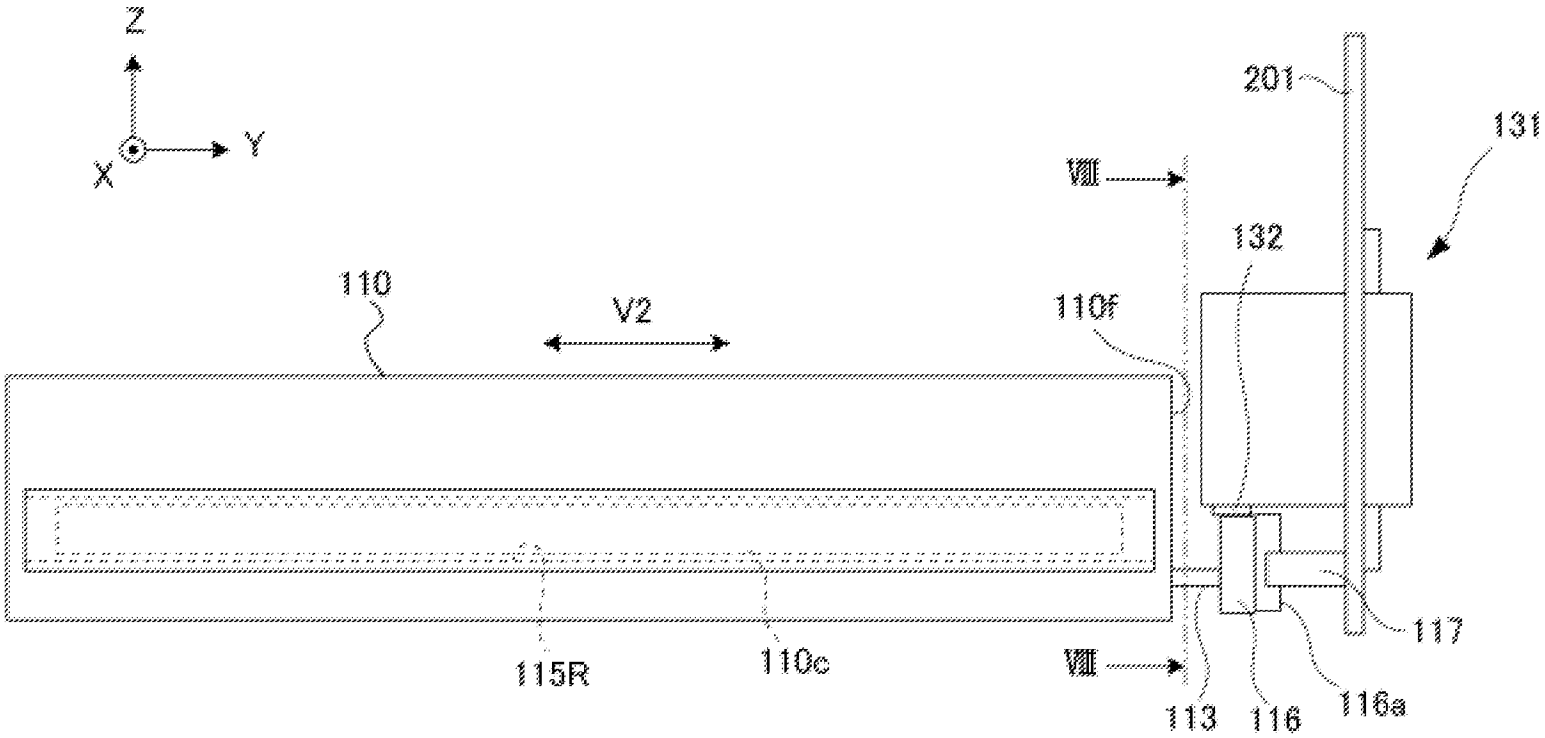
FIG. 5 is a schematic view for illustrating a drive configuration for a lifting and lowering plate in the first embodiment.
Figure 6:
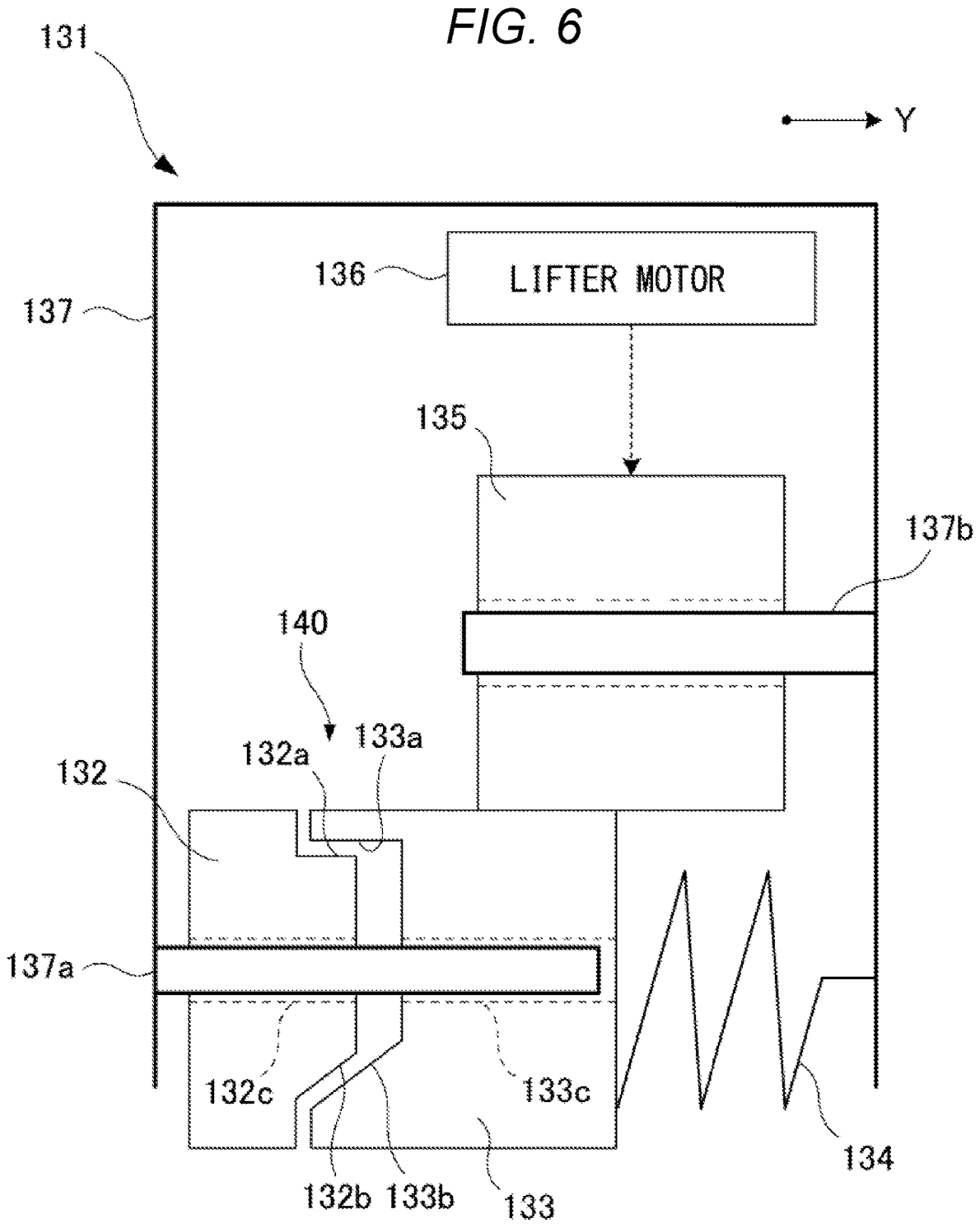
FIG. 6 is a schematic view for illustrating a drive unit in the first embodiment.
Figure 7:
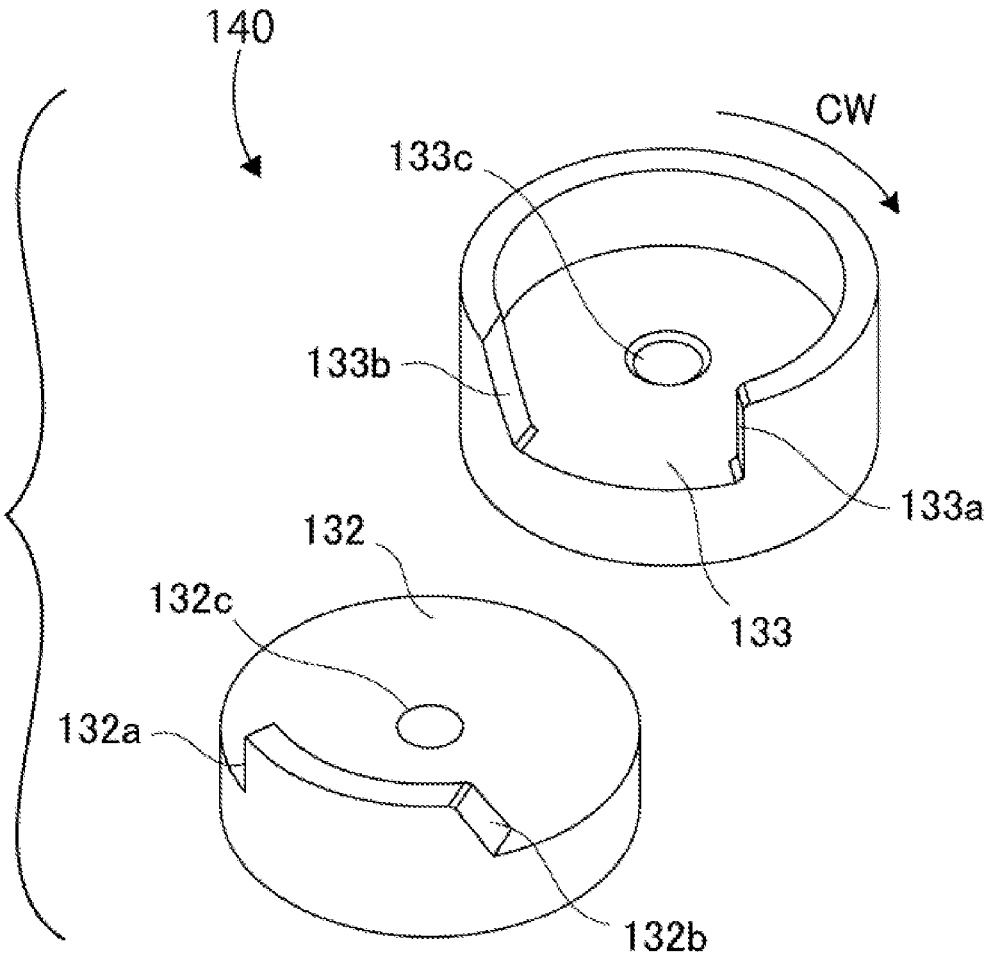
FIG. 7 is a perspective view for illustrating a coupling gear for the drive unit in the first embodiment.
Figure 8A:
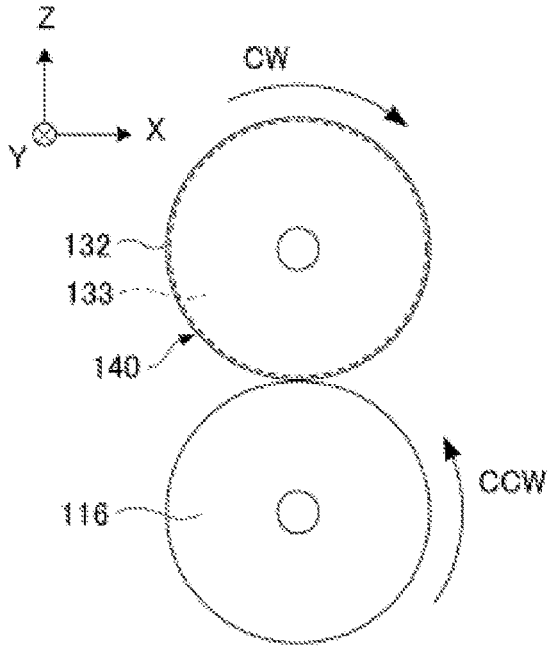
FIG. 8A is a schematic illustration of a rotation direction of a drive transmission member in a case of lifting the placement plate in the first embodiment.
Figure 8B:
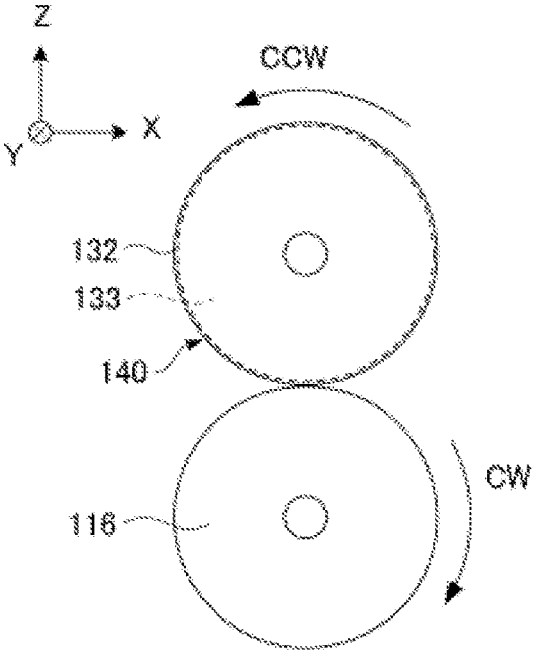
FIG. 8B is a schematic illustration of a rotation direction of the drive transmission member in a case of lowering the placement plate in the first embodiment.
Figure 9:
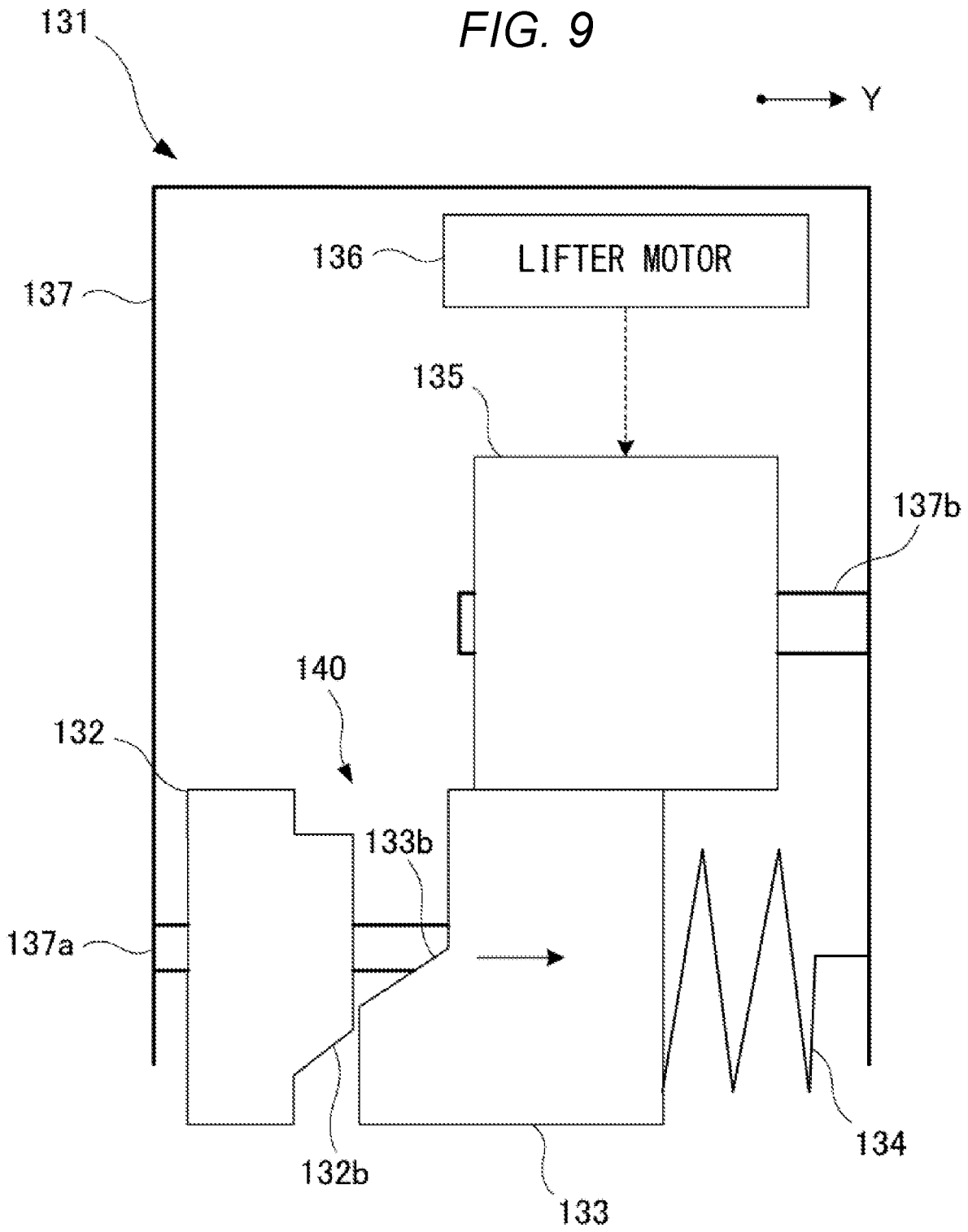
FIG. 9 is a schematic view for illustrating the drive unit in a state in which the coupling gear in the first embodiment is separated.

Next, with reference to FIG. 5 to FIG. 9, description is made of a drive mechanism for the lifting and lowering plate 112. FIG. 5 is a side view for illustrating a drive unit 131 configured to apply a driving force to the storage 110 and the lifting and lowering plate 112 in a state in which the storage 110 is mounted to the apparatus main body 201. FIG. 6 is a schematic view for illustrating the drive unit 131. FIG. 7 is a perspective view for illustrating a configuration of a coupling 140 provided to the drive unit 131. FIG. 8A and FIG. 8B are sectional views taken along the line VIII-VIII of FIG. 5, and are schematic illustrations of rotation directions of a lifter driving gear 132 and the lifting and lowering gear 116 which are rotary members forming the drive unit 131. FIG. 9 is a schematic view for illustrating the drive unit in a state in which a coupling gear is separated.

As illustrated in FIG. 5, the storage 110 is insertable into and drawable from the apparatus main body 201 in a direction V2 parallel to the Y axis as the holding portion 110*c* slides along the rail 115R. When a side surface 110*f* of the storage 110 on a downstream side in an insertion direction is brought into abutment against a positioning portion provided to the apparatus main body 201, the storage 110 is brought into a state of being mounted at a predetermined mounting position of the apparatus main body 201. Moreover, a storage sensor capable of detecting that the storage 110 is at the mounting position is provided to the apparatus main body 201. The drive unit 131 mounted to the apparatus main body 201 includes the lifter driving gear 132 configured to output a driving force. The lifter driving gear 132 and the above-mentioned lifting and lowering gear 116 are in mesh with each other when the storage 110 is at the mounting position.

As illustrated in FIG. 6, the drive unit 131 includes a lifter motor 136 being a drive source, an input gear 135, a coupling gear 133, and a lifter driving gear 132, and is accommodated in a cover 137 fixed to the frame of the apparatus main body 201. The input gear 135 is rotatably supported on a first shaft portion 137*b* mounted to the cover 137, and is rotated by a driving force input from the lifter motor 136. The coupling gear 133 and the lifter driving gear 132 are both rotatably supported on a second shaft portion 137*a* mounted to the cover 137 in parallel with the first shaft portion 137*b*. The coupling gear 133 is in mesh with the input gear 135, and the lifter driving gear 132 is rotated by a driving force received from the coupling gear 133.

The coupling 140 including the coupling gear 133 (first member) and the lifter driving gear 132 (second member) serves as a connection portion which is capable of transmitting the driving force between the lifter motor 136 and the lifting and lowering plate 112 and, under a certain condition, cancelling the drive transmission. A shaft hole 133*c* of the coupling gear 133 is slidable in the axial direction relative to the second shaft portion 137*a*, and the lifter driving gear 132 is supported on the second shaft portion 137*a* in a state of being positioned in the axial direction. That is, the coupling gear 133 is movable so as to approach and separate from the lifter driving gear 132. Moreover, the coupling gear 133 is urged toward the lifter driving gear 132 by a coupling spring 134 having one end fixed to the cover 137.

As illustrated in FIG. 6 and FIG. 7, on opposed surfaces of the coupling gear 133 and the lifter driving gear 132, there are formed drive transmission surfaces 132*a* and 133*a* and retreating surfaces 132*b* and 133*b*. The drive transmission surfaces 132*a* and 133*a* are surfaces which are perpendicular to respective rotation directions of the gears (parallel to the second shaft portion 137*a*), and the retreating surfaces 132*b* and 133*b* are surfaces which are inclined at the same angle with respect to respective rotation directions of the gears. With this configuration, the coupling gear 133 is engaged with the lifter driving gear 132 so as to be separable from the lifter driving gear 132. That is, the coupling 140 operates as a ratchet mechanism, and is capable of transmitting a force, which is applied in a direction against the force applied by the placement plate 111 to press the lifting and lowering plate 112 downward, to the lifting and lowering gear 116. The coupling 140 is an example of the connection portion, and other connection portions such as a one-way clutch or an electromagnetic clutch other than the ratchet mechanism may be used.

As illustrated in FIG. 8A, when the lifter motor 136 rotates in a first direction (rotates forwardly) to cause the coupling gear 133 to rotate in a clockwise direction (hereinafter referred to as "CW direction") in FIG. 8A, the lifter driving gear 132 rotates in the CW direction in a state in which the drive transmission surfaces 132*a* and 133*a* are held in abutment against each other. Thus, the lifting and lowering gear 116 is driven to rotate in a counterclockwise direction (hereinafter referred to as "CCW direction") in FIG. 8A. Accordingly, the lifting and lowering plate 112 is rotated upward to lift the placement plate 111.

Meanwhile, as illustrated in FIG. 8B, when the lifter motor 136 rotates in a second direction opposite to the first direction (rotates reversely), the coupling gear 133 rotates in the CCW direction. At this time, the state of drive transmission by the coupling 140 is changed in accordance with a position of the placement plate 111. When the placement plate 111 is at a position above the lower limit position, the weights of the placement plate 111 and the sheets S placed on the placement plate 111 act in a direction of causing the lifting and lowering gear 116 to rotate in the CW direction, that is, act in a direction of maintaining the abutment of the drive transmission surfaces 132*a* and 133*a* against each other. In this case, the lifter driving gear 132 rotates in the CCW direction together with the coupling gear 133 in the state in which the lift driver gear 132 is engaged with the coupling gear 133. Moreover, the lowering speed of the placement plate 111 is regulated by the lifter motor 136.

When the placement plate 111 is lowered to the lower limit position (see FIG. 2A), the weights of the placement plate 111 and the sheets S are supported by the placement plate support portion 110*d*. At this time, the force of causing the lifting and lowering gear 116 to rotate in the CW direction is lost, and the rotation of the lifting and lowering gear 116 is stopped. When the coupling gear 133 further continues the rotation in the CCW direction, as illustrated in FIG. 9, the retreating surface 133*b* of the coupling gear 133 is brought into abutment against the retreating surface 132*b* of the lifter driving gear 132, and retreats while sliding along the inclined surface (see FIG. 9). With this action, the coupling gear 133 moves against the urging force of the coupling spring 134 in the direction of separating from the lifter driving gear 132 in a state of being in mesh with the input gear 135, and separates from the lifter driving gear 132.

The drive amount of the lifter motor 136 given at the time of lowering the placement plate 111 to the lower limit position is set with a sufficient margin based on a detection signal of a sheet remaining amount sensor 117 described later so that the placement plate 111 reliably arrives at the lower limit position. The margin of the drive amount of the lifter motor 136 is absorbed as, after the placement plate 111 arrives at the lower limit position, the coupling gear 133 retreats from the lifter driving gear 132 by the above-mentioned retreating operation and idles.

Figure 10:
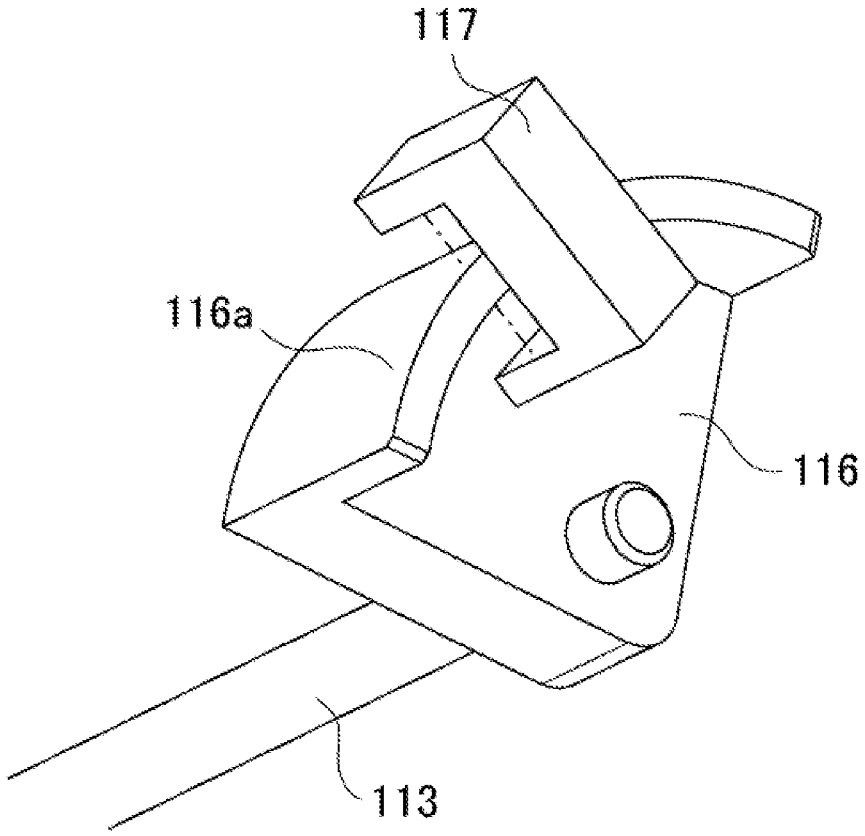
FIG. 10 is an enlarged view for illustrating a detection configuration for a sheet remaining amount in the first embodiment.

Next, description is made of a configuration for detecting a remaining amount of the sheets S stacked on the placement plate 111, and lifting and lowering control of the placement plate 111 based on a detection result. FIG. 10 is an enlarged view for illustrating the remaining amount sensor 117 being a detection unit configured to detect the amount of sheets S stacked on the placement plate 111. The remaining amount sensor 117 being a photoelectric sensor of a transmission type is mounted to the apparatus main body 201, and is capable of detecting a detection object portion 116*a*, which is provided to the lifting and lowering gear 116, in a state in which the storage 110 is at the mounting position. The remaining amount sensor 117 and the detection object portion 116*a* have such a configuration that a detection result changes when the lifting and lowering gear 116 passes a predetermined angle, that is, when the placement plate 111 is rotated upward by a predetermined rotation amount or more from the lower limit position. Thus, for example, it is determined that the remaining amount of the sheets S stacked on the placement plate 111 is small when the detection result of the remaining amount sensor 117 is in an OFF state (transmitting state). It is determined that the remaining amount of the sheets S is large when the detection result of the remaining amount sensor 117 is in an ON state (blocking state).

Figure 11:
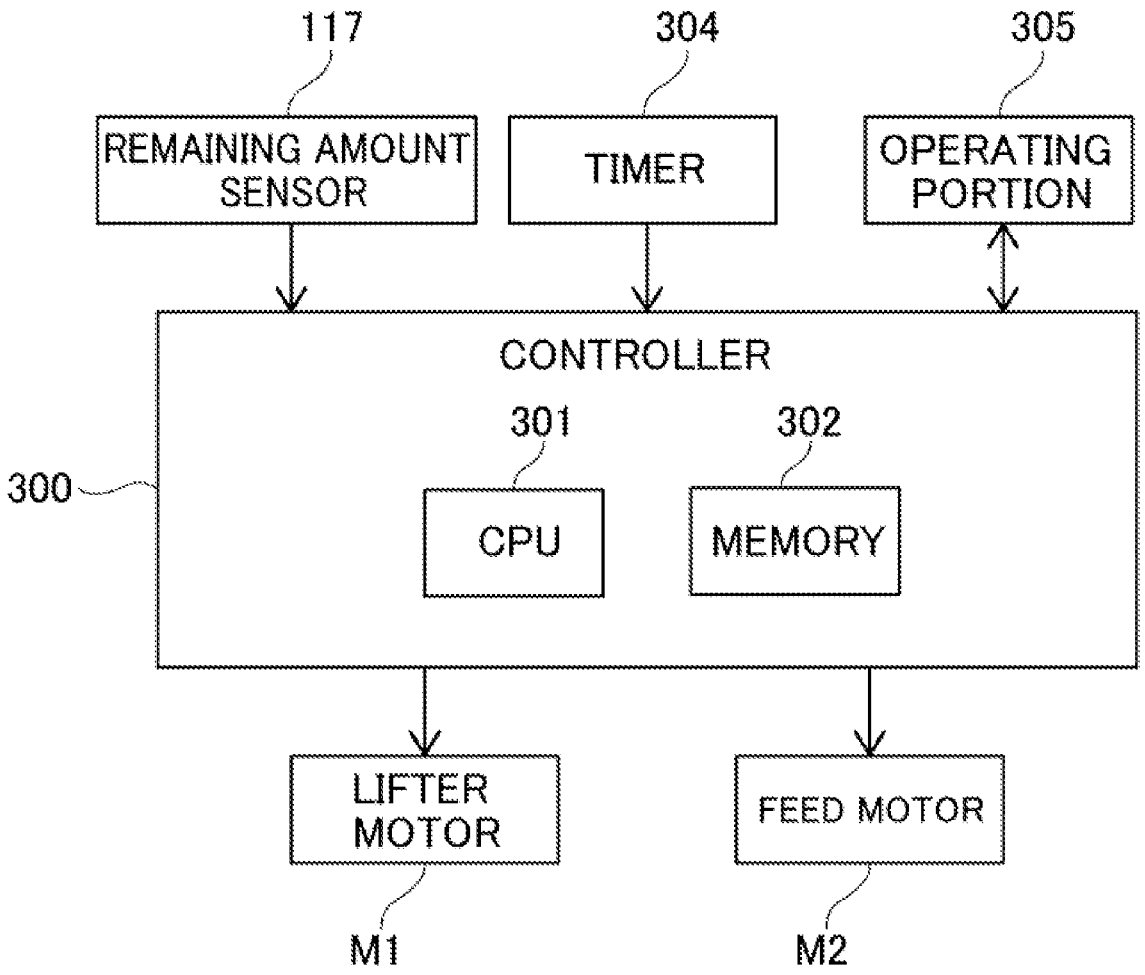
FIG. 11 is a block diagram for illustrating a control configuration for the sheet feeding apparatus in the first embodiment.

FIG. 11 is a block diagram for illustrating a control configuration for the sheet feeding apparatus. A controller 300 including a central processing unit (CPU) 301 and a memory 302 is connected to, for example, a timer 304 and an operating portion 305, in addition to the remaining amount sensor 117. The operating portion 305 is a user interface for the image forming apparatus 200, and includes a print button for giving an instruction to start an image forming job, a sleep button for bringing the image forming apparatus 200 into a hibernate state, and a device such as a liquid crystal panel. Moreover, the operating portion 305 has a control configuration for receiving an input signal given through an operation by a user and outputting a screen display. The CPU 301 of the controller 300 is capable of reading a program stored in the memory 302 and executing the program, and is configured to control the operation of the sheet feeding apparatus 100 by controlling a lifter motor M1, a feed motor M2, and other actuators.

Figure 12A:
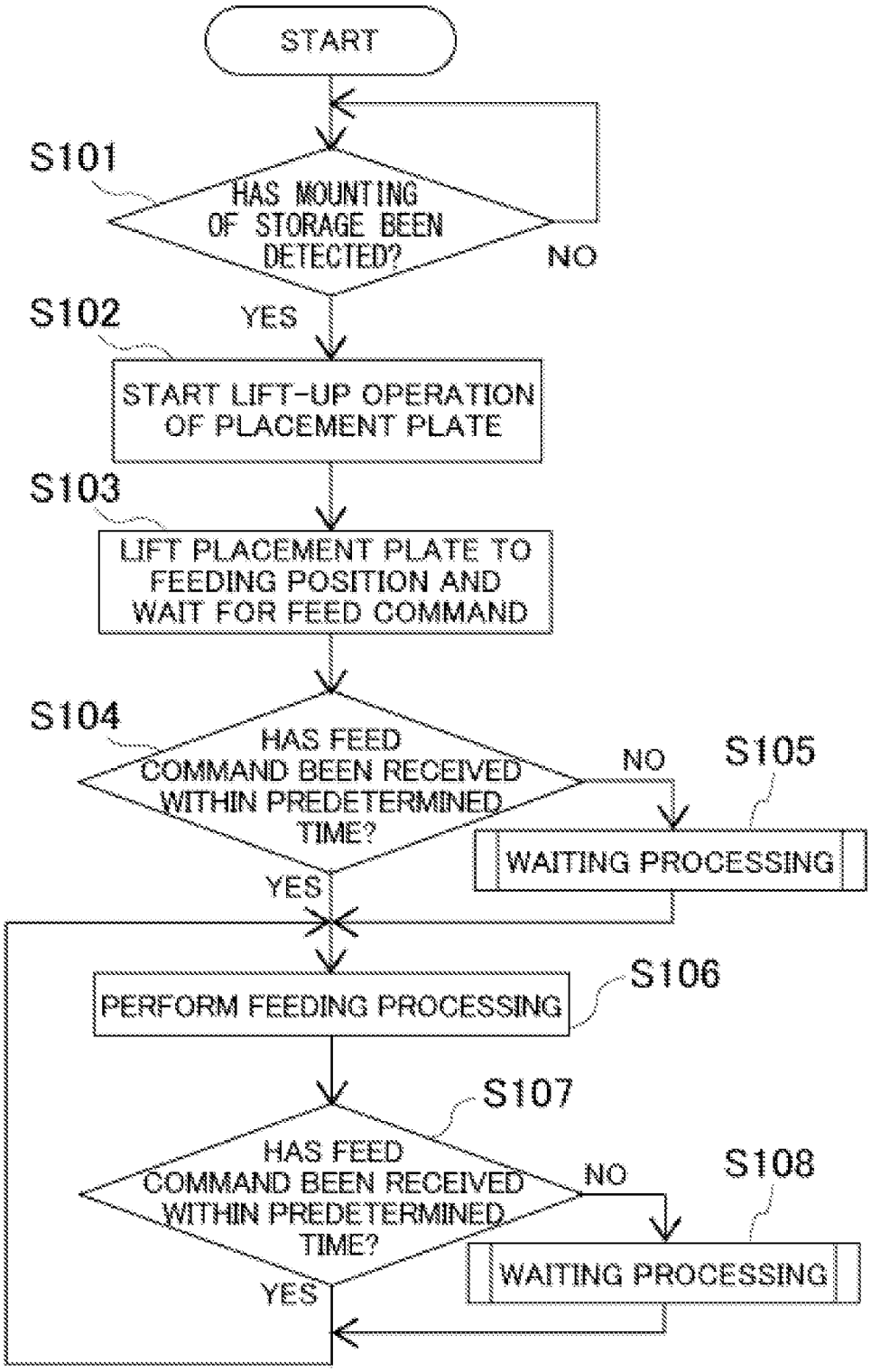
FIG. 12A is an overall flowchart for illustrating a control method for the sheet feeding apparatus in the first embodiment.
Figure 12B:
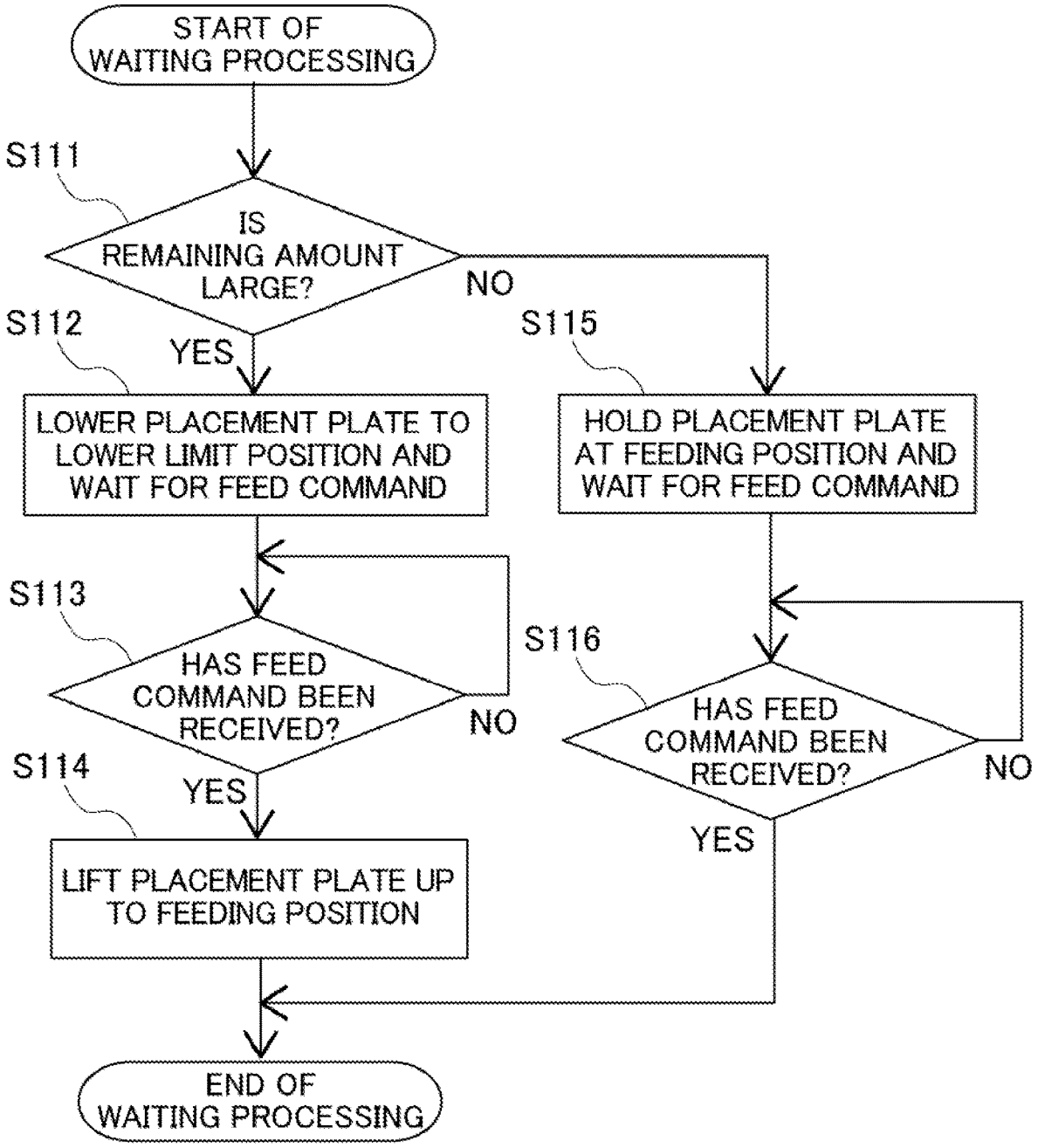
FIG. 12B is a flowchart for illustrating a waiting processing for the sheet feeding apparatus in the first embodiment.

Now, with reference to flowcharts of FIG. 12A and FIG. 12B, description is made of a control method for the sheet feeding apparatus 100 in relation to the lifting and lowering operation of the placement plate 111. The steps of the flowcharts described below are performed by the controller 300 being a control unit. Moreover, the following control process is started each time the storage 110 is mounted to the apparatus main body 201. When the storage 110 is drawn out, the control process is reset.

When mounting of the storage 110 to the apparatus main body 201 is detected (Step S101 in FIG. 12A), the lift-up operation of the placement plate 111 is started (Step S102). When it is detected that the placement plate 111 has been lifted to the feeding position based on a detection signal from the sheet height detection unit, the lift-up operation is terminated, and the sheet feeding apparatus 100 waits for a feed command (Step S103). In this state, when the feed command is received within a predetermined time (first time period) (YES in Step S104), feeding processing of causing the feeding unit 100B to feed the sheet S is performed (Step S106). The feed command corresponds to a signal for requesting the start of feeding the sheet S, and is issued when the image forming job is to be executed. When no feed command has been received within the predetermined time, waiting processing described later (Step S105 in FIG. 12B) is performed.

In the feeding processing, the feeding unit 100B is driven by the feed motor M2, and a required number of sheets S are fed to the image forming portion 20 in accordance with a content of the image forming job. When the sheets S are reduced during the feeding processing, and the detection result of the sheet height detection unit is changed, an additional lift-up operation is suitably performed so as to maintain a height of an uppermost sheet at a predetermined position. Based on the detection result of the remaining amount sensor 117, the CPU 301 monitors whether or not the lifting and lowering plate 112 has exceeded a predetermined angle during the feeding processing, that is, whether or not the sheet remaining amount has been reduced to a predetermined amount or less.

After the feeding processing is performed, when the next feed command has been received within a predetermined time (second time period) (YES in Step S107), the next feeding processing is started (Step S106). Meanwhile, when no feed command has been received within the predetermined time, the waiting processing (Step S108) is started.

As illustrated in FIG. 12B, in the waiting processing, a position of the placement plate 111 in the waiting state is determined in accordance with a remaining amount of the sheets S placed on the placement plate 111. That is, when the remaining amount of the sheets S is large (YES in Step S111), the lifter motor 136 is driven reversely to lower the placement plate 111 to the lower limit position (Step S112), and the sheet feeding apparatus 100 is caused to wait until the next feed command is received (Step S113). After that, when the feed command has been received (YES in Step S113), the placement plate 111 is lifted up to the feeding position (Step S114), and the feeding processing is started (Step S106). Meanwhile, when the remaining amount of the sheets S is small (NO in Step S111), the rotation of the lifter motor 136 is stopped, and the sheet feeding apparatus 100 waits in a state in which the placement plate 111 is held at the feeding position (Step S115). After that, when the feed command has been received (YES in Step S116), the feeding processing is started in the state in which the placement plate 111 is held at the feeding position (Step S106).

As described above, in the first embodiment, different modes can be selected in accordance with a position of the placement plate 111 in the waiting state, that is, the lower limit position (first position) and the feeding position (second position), and the mode is selected in accordance with the remaining amount of the sheets S placed on the placement plate 111 (Step S111). When a first amount of sheets S is stacked on the placement plate 111, there is selected a mode of waiting for the next feeding processing in the state in which the placement plate 111 is at the lower limit position at which the placement plate 111 is supported by the bottom portion 110*a* of the storage 110. In other words, there is selected a first mode of waiting for the start of the feeding processing in a state in which the sheet stacking portion is at the first position. With this, as compared to a case in which the lifting and lowering unit always holds the placement plate 111 at the feeding position in the waiting state, a load acting on the lifting and lowering unit is reduced, thereby being capable of preventing disadvantages such as deformation of the lifting and lowering plate 112 and the rotary shaft 113 thereof.

Meanwhile, when a second amount, which is smaller than the first amount, of the sheets S are stacked on the placement plate 111, there is selected a mode of waiting for the next feeding processing in the state in which the placement plate 111 is held at the feeding position. In other words, there is selected a second mode of waiting for the start of the feeding processing in a state in which the sheet stacking portion is held at the second position by the lifting and lowering unit. In this case, the load acting on the lifting and lowering unit is small, and hence the risk of causing deformation is small even when the placement plate 111 is continuously held at the feeding position. Moreover, the next feeding processing is started while the placement plate 111 is held at the feeding position, and hence the waiting time from issuing of the feed command to feeding of the first sheet S is minimized, thereby being capable of contributing to improvement in productivity.

A moving distance of the placement plate 111 from the lower limit position to the feeding position changes depending on the remaining amount of the sheets S, and the moving distance becomes smaller as the remaining amount of the sheets S becomes larger. Thus, when the remaining amount of the sheets S is large, it is required to perform, before starting the feeding processing, a step of moving the placement plate 111 from the lower limit position in the waiting state to the feeding position (Step S114), but the influence on the productivity is relatively small. Meanwhile, when the remaining amount of the sheets S is small, the advantage of improvement in productivity which can be attained by holding the placement plate 111 at the feeding position is relatively large.

Incidentally, as a configuration for stably performing the lifting and lowering operation for the sheets S for a long period of time, it is conceivable to improve positioning accuracy for members by improving rigidity or modularity of, for example, members forming the lifting and lowering unit or gears configured to transmit the driving force to the lifting and lowering unit. Moreover, as another method, it is conceivable to provide a fitting portion configured to improve positioning accuracy for the storage and the apparatus main body in the mounting state (for example, a configuration of inserting a pin projecting from the storage 110 into a recessed portion of the apparatus main body 201). However, those methods may hinder reduction in cost and space saving. Thus, when the fitting portion is to be provided, sufficient strength is required for the fitting portion, with the result that a degree of freedom in design may be impaired. Moreover, even when the rigidity of the lifting and lowering unit or the gears is improved, there is a risk of causing creep deformation during a long-time use. Meanwhile, with the configuration according to the first embodiment, the load which acts on the lifting and lowering unit in the waiting state is reduced, thereby being capable of stably performing the lifting and lowering operation for the sheets S for a long period of time while preventing such disadvantages.

In the first embodiment, description is given of the configuration in which the lifting and lowering control for the placement plate 111 depending on the remaining amount of the sheets S is executed in both the case in which the feeding processing is not performed within the predetermined time after mounting of the storage 110 and the case in which the next feeding processing is not performed within the predetermined time after the feeding processing. However, there may be employed a configuration of executing the lifting and lowering control only in any one of those cases. Moreover, a time from the mounting of the storage 110 to the start of the lifting and lowering control (first time period) and a time from the feeding processing to the start of the lifting and lowering control (second time period) may be set to differ from each other.

Moreover, it is preferred that a threshold value to be used for determination of whether the remaining amount of the sheets S is large or small be suitably changed in consideration of, for example, durability of members to be used as the lifting and lowering unit or a stacking capacity with respect to the sheet stacking portion. Further, in the first embodiment, the placement plate 111 is lifted up to the feeding position when the storage 110 is mounted. However, determination of whether or not to lift the placement plate 111 depending on the stacking amount of the sheets S may be made at the time when the storage 110 is mounted. In this case, it is preferred that a configuration capable of detecting the amount of sheets stacked on the placement plate 111 in a state in which the placement plate 111 is at the lower limit position, such as a sensor capable of directly detecting the upper surface of the uppermost sheet, be used.

Second Embodiment

Next, description is made of a sheet feeding apparatus according to a second embodiment of the present invention. In the second embodiment, an operation of moving the placement plate to the lower limit position in the hibernate state of the image forming apparatus is performed. However, the hibernate state is a power mode such as a so-called power-saving mode or a sleep mode which is set so as to reduce power consumption in a state (standby state) in which the image forming operation is not performed as compared to the normal mode. In the hibernate state, for example, the supply of power to the heat source 42 of the fixing device 40 is suppressed or blocked, and energization of sensors such as the remaining amount sensor 117 is stopped.

The hibernate state is started based on a trigger such as elapse of a certain time in a state in which no image forming job is input, or pressing of the sleep button by a user. Moreover, for example, when the input of the image forming job is detected in the hibernate state, or when the sleep button is pressed again, the image forming apparatus returns from the hibernate state to the normal mode.

Figure 13:
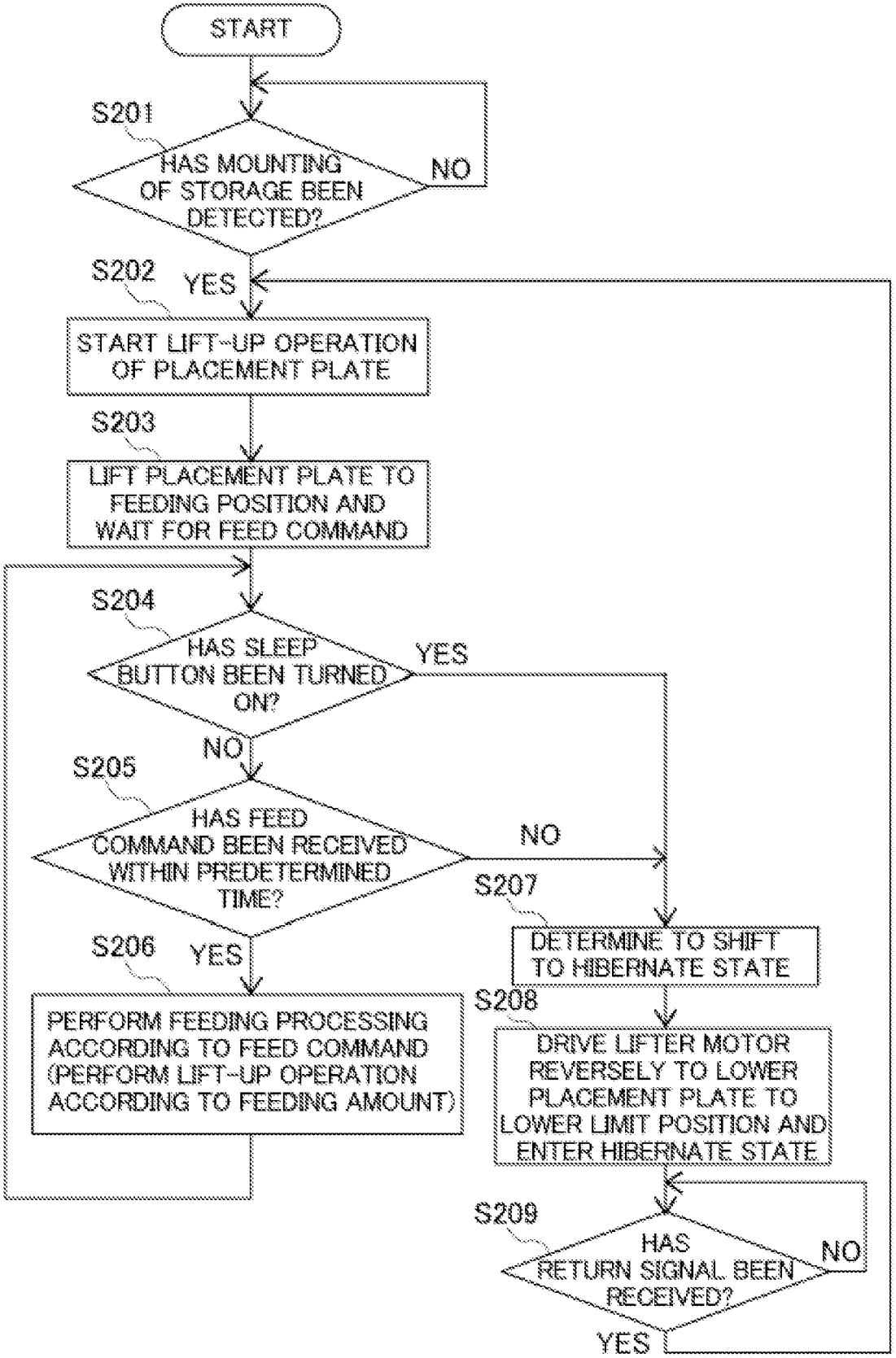
FIG. 13 is a flowchart for illustrating a control method for a sheet feeding apparatus in a second embodiment of the present invention.

Now, a control method for a sheet feeding apparatus in the second embodiment is described with reference to the flowchart of FIG. 13. The steps of the flowchart described below are performed by the controller 300 mounted to the image forming apparatus 200 similarly to the first embodiment. Moreover, components which are common with those of the first embodiment, such as the members forming the sheet feeding apparatus, are denoted by the same reference symbols as those of the first embodiment, and description thereof is omitted.

Similarly to the first embodiment, the following control process is started each time a user stacks the sheets S on the storage 110 and mounts the storage 110 to the apparatus main body 201. When the storage 110 is drawn out from the apparatus main body 201, the control process is reset. When mounting of the storage 110 is detected by a sensor of the apparatus main body 201 (Step S201), the lift-up operation of the placement plate 111 is started (Step S202), and the placement plate 111 is lifted to the feeding position and waits thereat (Step S203). When the sleep button is not pressed (NO in Step S204), and a feed command is received within a predetermined time after the placement plate 111 has been lifted up (YES in Step S205), the feeding processing is started based on the feed command (Step S206). After the feeding processing is performed, when the next feed command is received within a predetermined time, the next feeding processing is started based on the feed command.

When the number of sheets S is reduced during the feeding processing, and a detection result of the sheet height detection unit is changed, similarly to the first embodiment, an additional lift-up operation is suitably performed to maintain a sheet height of the uppermost sheet at a predetermined position. Based on the detection result of the remaining amount sensor 117, the CPU 301 monitors whether or not the lifting and lowering plate 112 has exceeded a predetermined angle during the feeding processing, that is, whether or not the sheet remaining amount has become equal to or less than a predetermined amount during the feeding processing.

Meanwhile, when the sleep button is pressed while waiting for the feed command (YES in Step S204), a shift to the hibernate state is determined (Step S207). Moreover, when the feed command has not been received even after elapse of a predetermined time from the lift-up operation of the placement plate 111, or when the next feed command has not been received within a predetermined time after the feeding processing (NO in Step S205), the shift to the hibernate state is determined (Step S207). In this case, the lifter motor 136 is driven reversely to lower the placement plate 111 to the lower limit position (Step S208). With this, for example, together with the stop of the supply of power to the fixing device 40, the image forming apparatus is brought into the hibernate state. When a signal serving as a trigger for returning from the hibernate state, such as input of the image forming job, has been received (YES in Step S209), the placement plate 111 is lifted up to the feeding position by forward drive of the lifter motor 136 (Step S202 and Step S203). After that, the feeding processing is performed when the feed command has been received within the predetermined time. However, when the feed command has not been received, the image forming apparatus is shifted to the hibernate state again.

As described above, in the second embodiment, the following control is performed (Step S207 to Step S209). That is, when the image forming apparatus is switched from the normal state to the hibernate state, the placement plate 111 is lowered to the lower limit position. When the image forming apparatus is returned to the normal state, the placement plate 111 is lifted to the feeding position. In other words, the following processing is performed. That is, when the image forming apparatus is switched from the first state to the second state with small power consumption in a state in which the sheet stacking portion is at the second position, the sheet stacking portion is moved from the second position to the first position by the lifting and lowering unit. Moreover, when the image forming apparatus is switched from the second state to the first state, the sheet stacking portion is moved from the first position to the second position by the lifting and lowering unit.

With this, similarly to the first embodiment, the load acting on the lifting and lowering unit is reduced in the hibernate state in which the image forming apparatus waits without receiving the feed command, thereby being capable of preventing the disadvantages such as deformation of the lifting and lowering plate 112 and the rotary shaft 113 thereof. With this, the configuration of stably performing the lifting and lowering of the sheets for a long period of time can be achieved.

Another Embodiment

The control methods described in the first and second embodiments above may be combined with each other. For example, in a sheet feeding apparatus capable of switching between the normal state and the hibernate state, it is conceivable to employ a configuration of performing the control method described in the first embodiment only in the normal state and moving the placement plate to the lower limit position in the hibernate state regardless of the remaining amount of the sheets S. Moreover, when the image forming apparatus is switched from the normal state to the hibernate state, determination may be made on whether or not to move the placement plate to the lower limit position in accordance with the remaining amount of the sheets S.

Moreover, in the first and second embodiments above, description is made of an example configuration of the sheet feeding apparatus in which the storage 110 accommodated in the image forming apparatus 200 is provided. However, the present technology is applicable also to a sheet feeding apparatus having other configurations. For example, through application of the present technology also to a large-capacity deck that is to be connected as an option to the image forming apparatus 200, effects similar to those of the embodiments described above can be attained.

Moreover, in the first and second embodiments above, description is made of the color electrophotographic device of an intermediate transfer type as an example of the image forming apparatus. However, for example, the present technology is applicable also to a monochromatic electrophotographic device of a direct transfer type and a device including an image forming unit of an ink jet type. Moreover, the sheet feeding apparatus is not limited to the sheet feeding apparatus configured to feed a sheet being a recording medium to the image forming unit, and may be a sheet feeding apparatus configured to feed a sheet being an original to an image reading portion in the image reading apparatus. The image reading portion is an optical unit configured to optically scan a sheet and convert reflected light from the sheet into an electric signal by a photoelectric conversion element mounted to the image reading apparatus.

In the first and second embodiments above, a margin is set to the rotation amount of the lifter motor 136 during the reverse rotation operation so that the placement plate 111 is reliably lowered to the lower limit position, and the drive time of the motor is set long. However, for example, there may be employed a configuration in which the remaining amount sensor 117 is capable of detecting the remaining amount of the sheets S at a plurality of detection levels, or a configuration in which the rotation amount of the lifter motor 136 is more accurately controlled by arranging a sensor capable of directly detecting a position of the placement plate 111 In this case, the configuration of releasing a drive coupling between the lifter motor 136 and the lifting and lowering plate 112 like the above-mentioned coupling 140 may be omitted.

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-152483, filed Aug. 7, 2017, which is hereby incorporated by reference herein in its entirety.

What is claimed is:

1. A sheet feeding apparatus, comprising:

a storage unit configured to store sheets;

a sheet stacking portion provided in the storage unit so that the sheets are stacked on the sheet stacking portion, the sheet stacking portion being configured to be lifted and lowered relative to the storage unit;

a feeding unit configured to feed the sheets stacked on the sheet stacking portion;

a lifting and lowering unit configured to move the sheet stacking portion between a first position at which the sheet stacking portion abuts against a bottom portion of the storage unit and a second position above the first position;

a detection unit configured to detect an amount of the sheets stacked on the sheet stacking portion; and a control unit configured to perform feeding processing of causing the feeding unit to feed the sheets stacked on the sheet stacking portion in a state in which the sheet stacking portion is at the second position, wherein the control unit executes a first mode of waiting for start of the feeding processing in a state in which the sheet stacking portion is at the first position and a second mode of waiting for start of the feeding processing in a state in which the sheet stacking portion is held at the second position by the lifting and lowering unit, wherein the control unit is configured to execute the first mode when sheets of a first amount are stacked on the sheet stacking portion based on a detection result of the detection unit and execute the second mode when sheets of a second amount less than the first amount are stacked on the sheet stacking portion, wherein the control unit is configured to switch between a first state for performing the feeding processing and a second state which is set so that power consumption is less as compared to that in the first state, and wherein, when the first state is switched to the second state in a state in which the sheet stacking portion is at the second position, the control unit causes the lifting and lowering unit to move the sheet stacking portion from the second position to the first position regardless of the amount of the sheets stacked on the sheet stacking portion and executes the first mode.

2. A sheet feeding apparatus according to claim 1, wherein in a case in which a predetermined time has elapsed in a state in which the sheet stacking portion is at the second position and in which the feeding processing is not performed and in a case in which the sheets of the first amount are stacked based on the detection result of the detection unit, the control unit causes the lifting and lowering unit to move the sheet stacking portion from the second position to the first position and executes the first mode.

3. A sheet feeding apparatus according to claim 1, wherein in a case in which a predetermined time has elapsed in a state in which the next feeding processing is not performed after the feeding processing is completed and in a case in which the sheets of the first amount are stacked based on the detection result of the detection unit, the control unit causes the lifting and lowering unit to move the sheet stacking portion from the second position to the first position and executes the first mode.

4. A sheet feeding apparatus according to claim 1, wherein the storage unit comprises a cassette drawably mounted to a main body of the sheet feeding apparatus, wherein, when the cassette is mounted to the main body, the control unit causes the lifting and lowering unit to move the sheet stacking portion to the second position, and wherein in a case in which a predetermined time has elapsed in a state in which the feeding processing is not performed after the sheet stacking portion is moved to the second position and in a case in which the sheets of the first amount are stacked based on the detection result of the detection unit, the control unit causes the lifting and lowering unit to move the sheet stacking portion from the second position to the first position and executes the first mode.

5. A sheet feeding apparatus according to claim 1, wherein the sheet stacking portion comprises a plate-shaped member including a first surface on which the sheets are stacked and a second surface opposite to the first surface, and wherein the second surface abuts against the storage unit when the sheet stacking portion is at the first position, and the second surface is separated from the storage unit when the sheet stacking portion is at the second position.

6. A sheet feeding apparatus according to claim 1, wherein the lifting and lowering unit includes a rotary member rotatably supported on the storage unit, and wherein the detection unit comprises a sensor configured to detect that a rotation amount of the rotary member exceeds a predetermined angle.

7. A sheet feeding apparatus according to claim 1, further comprising:

a drive source configured to drive the lifting and lowering unit; and a connection portion configured to connect the drive source and the lifting and lowering unit to each other, wherein, when the sheet stacking portion is at the first position, the drive source and the lifting and lowering unit are disconnected from each other.

8. A sheet feeding apparatus according to claim 7, wherein the connection portion includes a first member configured to be rotated by the drive source and a second member connected to the lifting and lowering unit and configured to be separably engaged with the first member, wherein, when the first member rotates in a first direction, the second member rotates in the first direction together with the first member to cause the lifting and lowering unit to lift the sheet stacking portion, and wherein, when the first member rotates in a second direction opposite to the first direction in a state in which the sheet stacking portion is at the first position, the first member and the second member are separated from each other, and the first member idly rotates.

9. An image forming apparatus, comprising:

a storage unit configured to store sheets;

a sheet stacking portion provided in the storage unit so that the sheets are stacked on the sheet stacking portion, the sheet stacking portion being configured to be lifted and lowered relative to the storage unit;

a feeding unit configured to feed the sheets stacked on the sheet stacking portion;

an image forming unit configured to form images on the sheets fed by the feeding unit;

a lifting and lowering unit configured to move the sheet stacking portion between a first position at which the sheet stacking portion abuts against a bottom portion of the storage unit and a second position above the first position;

a detection unit configured to detect an amount of the sheets stacked on the sheet stacking portion; and a control unit configured to perform feeding processing of causing the feeding unit to feed the sheets stacked on the sheet stacking portion in a state in which the sheet stacking portion is at the second position, wherein the control unit executes a first mode of waiting for start of the feeding processing in a state in which the sheet stacking portion is at the first position and a second mode of waiting for start of the feeding processing in a state in which the sheet stacking portion is held at the second position by the lifting and lowering unit, wherein the control unit is configured to execute the first mode when the sheets of a first amount are stacked on the sheet stacking portion based on a detection result of the detection unit and execute the second mode when sheets of a second amount less than the first amount are stacked on the sheet stacking portion, wherein the control unit is configured to switch between a first state for performing the feeding processing and a second state which is set so that power consumption is less as comparted to that in the first state, and wherein, when the first state is switched to the second state in a state in which the sheet stacking portion is at the second position, the control unit causes the lifting and lowering unit to move the sheet stacking portion from the second position to the first position regardless of the amount of the sheets stacked on the sheet stacking portion and executes the first mode.

* * * * *